US005830008A

United States Patent [19]

Broschard, III

[11] Patent Number: 5,830,008

[45] Date of Patent: Nov. 3, 1998

[54] PANEL MOUNTABLE CONNECTOR

[75] Inventor: John Lawrence Broschard, III, Hershey, Pa.

[73] Assignee: The Whitaker Corporation, Wilmington, Del.

[21] Appl. No.: 768,149

[22] Filed: Dec. 17, 1996

[51] Int. Cl.[6] ..... H01R 13/73

[52] U.S. Cl. ..... 439/557

[58] Field of Search ..... 439/557, 558, 439/567, 933, 552, 554, 555, 352, 353, 357, 358, 562, 563, 247, 248

[56] References Cited

U.S. PATENT DOCUMENTS

| | | | |
|---|---|---|---|
| 3,289,145 | 11/1966 | Ruehlemann et al. | 439/357 |
| 3,753,212 | 8/1973 | Yamada et al. | 439/358 |
| 4,139,727 | 2/1979 | Kuballa | 439/557 |
| 4,541,036 | 9/1985 | Landries et al. | 439/557 |
| 4,717,358 | 1/1988 | Chaundy | 439/557 |
| 4,761,144 | 8/1988 | Hunt, III et al. | 439/545 |
| 4,824,387 | 4/1989 | deJong et al. | 439/557 |
| 4,990,094 | 2/1991 | Chandler et al. | 439/108 |
| 5,131,867 | 7/1992 | Peloza et al. | 439/552 |
| 5,178,554 | 1/1993 | Siemon et al. | 439/188 |
| 5,199,896 | 4/1993 | Mosquera | 439/557 |
| 5,249,982 | 10/1993 | Funk et al. | 439/557 |
| 5,372,523 | 12/1994 | Sakatani et al. | 439/552 |
| 5,382,168 | 1/1995 | Azuma et al. | 439/65 |
| 5,607,323 | 3/1997 | Foster et al. | 439/557 |
| 5,634,810 | 6/1997 | Niitsu et al. | 439/554 |

FOREIGN PATENT DOCUMENTS

| | | | |
|---|---|---|---|
| 0572012A1 | 1/1993 | European Pat. Off. | B60R 16/02 |
| 0572021A1 | 1/1993 | European Pat. Off. | H01R 13/74 |

*Primary Examiner*—Gary Paumen
*Attorney, Agent, or Firm*—Katherine A. Nelson

[57] ABSTRACT

A electrical connector (10) adapted to be inserted into and retained in a panel opening (46) includes a dielectric housing (12) having flanges (22) extending outwardly from opposed sides (16) thereof proximate a panel mounting face (14), each flange (22) having a resilient latching arm (24) and a spacing arm (30) extending forwardly therefrom, the spacing arm (30) being outward of the latching arm (24). The latching arm (24) has a latching surface (26) at the leading end thereof. The leading end (32) of the spacing arm (30) is spaced rearwardly from the latching surface (26) a selected distance such that, upon inserting the connector (10) into the panel opening (46) from the second side (44), the latching arms (24) engage the first side (42) of the panel (40) and the leading ends (32) of the spacing arms (30) engage the second side (44), thereby securing the connector (10) in the panel opening (46).

3 Claims, 2 Drawing Sheets

PANEL MOUNTABLE CONNECTOR

FIELD OF THE INVENTION

This invention is directed to electrical connectors and more particularly to electrical connectors that are mountable in an opening in a panel.

BACKGROUND OF THE INVENTION

It is known to mount connectors in openings in panels whereby the mating face of the connector is assessable from one side of the panel while the bulk of the connector is positioned on the opposite side of the panel. Such connectors are used, for example, in a rack and panel arrangement, or in computers or other electronic devices. In making such connectors, it is necessary to accommodate various thicknesses of panels, typically in the range of 0.032 to 0.25 inches. One method used to assure that the connector is securely held against the panel in the desired location is to mold a connector housing that is designed to be mounted to a panel having a specified thickness. This method requires the manufacturer to have molds dedicated to each of the required sizes and to maintain a large inventory of connectors for different thicknesses of panels. Additionally, the end user may need to maintain an inventory of different connectors, each mountable to panel of different thicknesses. Alternatively, a two piece connector assembly may be used with the pieces secured on opposite sides of the panel by fastening members, such as bolts or the like. The connector may also be mounted directly to the panel with various types of hardware, as known in the art. For more cost effective manufacturing and to reduce inventory for both the manufacturer and the end user, it is more desirable to have a one piece connector that can be readily adjusted to accommodate various thicknesses of panels in a mariner that eliminates using extraneous hardware to secure the connector to the panel.

SUMMARY OF THE INVENTION

The present invention is directed to an electrical connector adapted to be inserted into and retained in a panel opening, the connector having a housing with flanges extending outwardly from opposed sides thereof proximate a panel mounting face; each flange including a resilient latching arm and a spacing arm. The latching arm extends forwardly from a first location along the flange and includes a latching surface at the leading end thereof adapted to engage the first side of a panel when a connector is inserted into the panel opening from the second side of the panel. The spacing arm is at a second location along the flange and extends forwardly to a leading end, the second location being spaced outward of the first location from the associated housing side. The leading end of the spacing arm is spaced rearwardly of the latching surface a selected distance such that, upon inserting the connector into the panel opening, the latching arms engage the first side of the panel and the leading ends of the spacing arms engage the second side of the panel thereby securing the connector in the panel opening.

In the preferred embodiment, each spacing arm includes at least one frangible section at a selected location to facilitate severing of the arm at the location to permit the connector to be mounted to a thicker panel. The frangible section is preferably defined by a notch in the spacing arm. The invention is further directed to a connector wherein each spacing arm includes a plurality of frangible sections wherein the arm may be severed as desired at one of a number of locations to readily accommodate panels having different thicknesses.

It is an object of the present invention to provide a one piece panel mountable a connector that can readily accommodate panels having different thicknesses while securing the connector in the panel opening.

An embodiment of the invention will now be described with reference to the accompanying drawings.

DETAILED DESCRIPTION OF THE DRAWINGS

Figure 1:
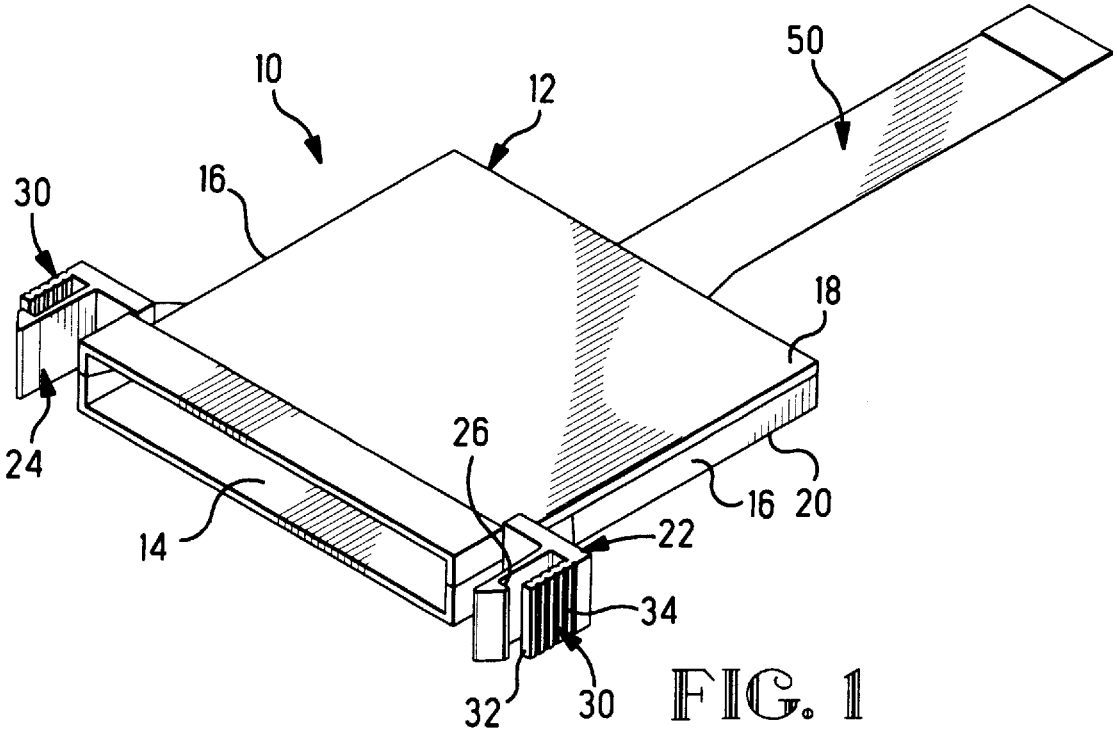
FIG. 1 is an isometric view of a connector made in accordance with the invention.
Figure 2:
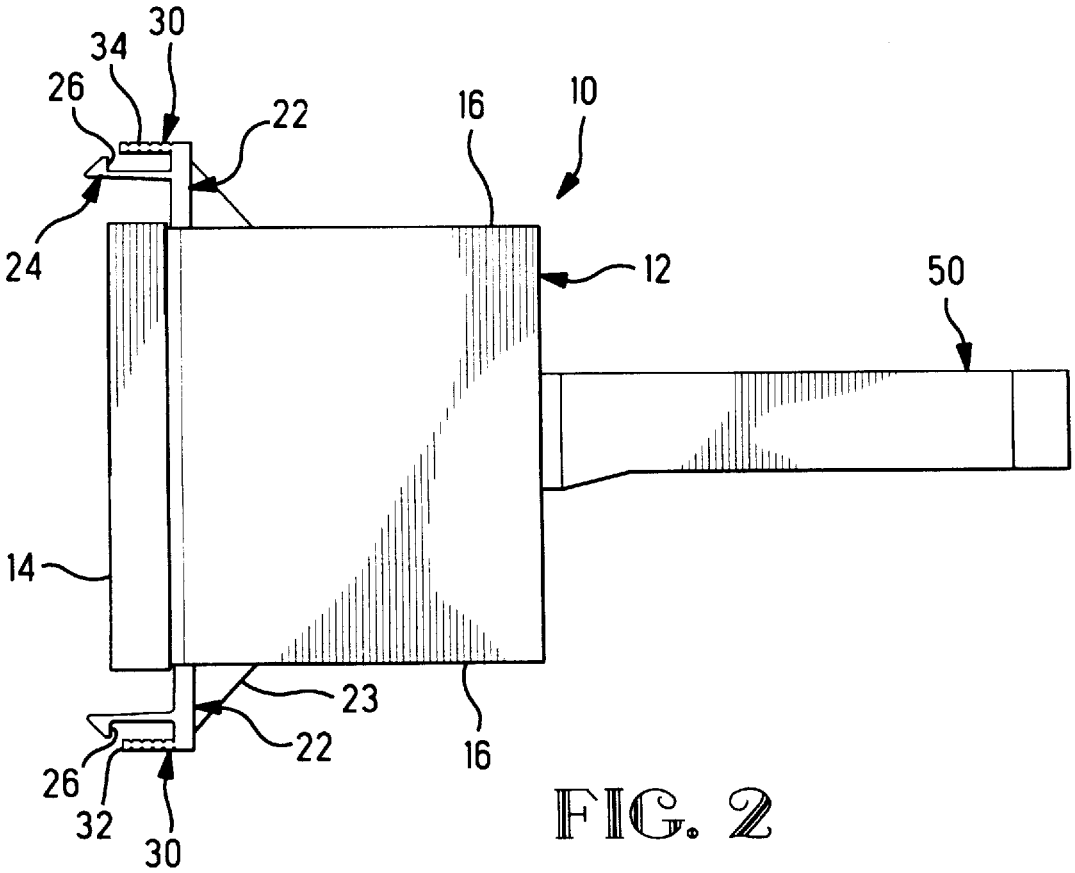
FIG. 2 is a top plan view of the connector of FIG. 1.

For purposes of illustrating the invention, the panel mounted connector is being shown as a smart card connector that is terminated to a cable 50. It is to be understood that the invention is not limited to smart card connectors.

The present invention is directed to an electrical connector 10 adapted to be inserted into and retained in a panel opening 46. Referring now to FIGS. 1 through 4, connector 10 includes a housing 12 having a panel mounting face 14, opposed sides 16 having flanges 22 extending outwardly therefrom. Housing 12 includes a base 20 and a cover 18 having a shrouded entry at the panel mounting face 14 for accepting a smart card (not shown) therein. Each flange 22 includes a resilient latching arm 24 extending forwardly therefrom at a first location therealong. Each latching arm 24 has a latching surface 26 at the leading end thereof adapted to engage a first side 42 of a panel 40, when the connector 10 is inserted into the panel opening 46 from a second side 44 of the panel 40. Each flange 22 further includes a spacing arm 30 at a second location therealong extending forwardly to a leading end 32. The second location is spaced outwardly along the flange of the first location from the associated side 16 of housing 12. The leading end 32 of the spacing arm 30 is spaced rearwardly from the latching surface 26 a selected distance such that, upon inserting the connector 10 into the panel opening 46 from the second side 44, the latching surface 26 of each latching arm 24 engage the first surface 42 of the panel 40 and concomitantly the leading ends 32 of the spacing arms 30 engage the second surface 44 of the panel thereby holding the connector 10 securely in position. The selected distance between the leading end 32 of the spacing arm 30 and the latching surface 26 of the latching arms 24 is defined by the thickness of the panel 40 to which the connector 10 is to be mounted.

In the preferred embodiment, the spacing arms 30 include a plurality of frangible sections 36 defined by a plurality of notches 34 such that the spacing arm 30 may be severed at a desired location to readily accommodate panels having different thicknesses.

Figure 3:
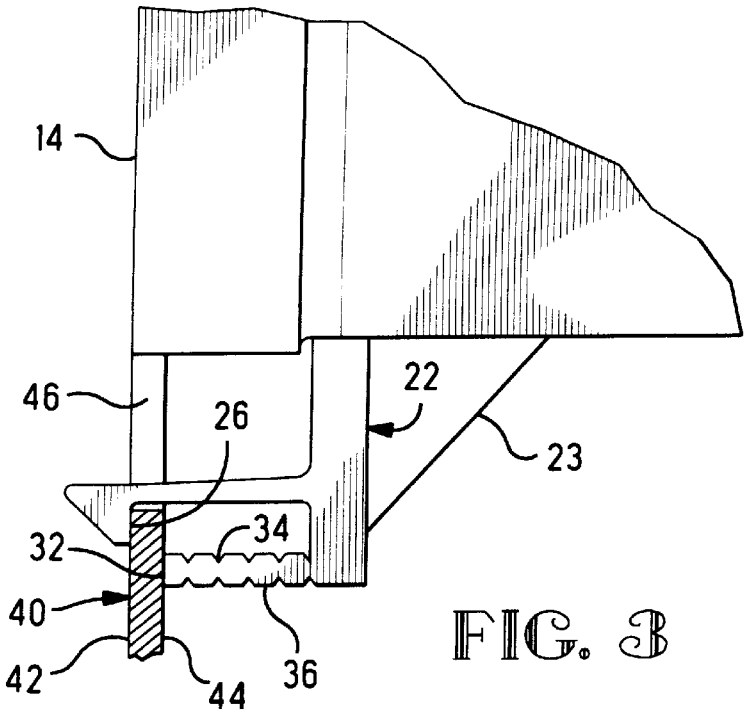
FIG. 3 is a fragmentary portion of the connector of FIG. 1 mounted to a thin panel.
Figure 4:
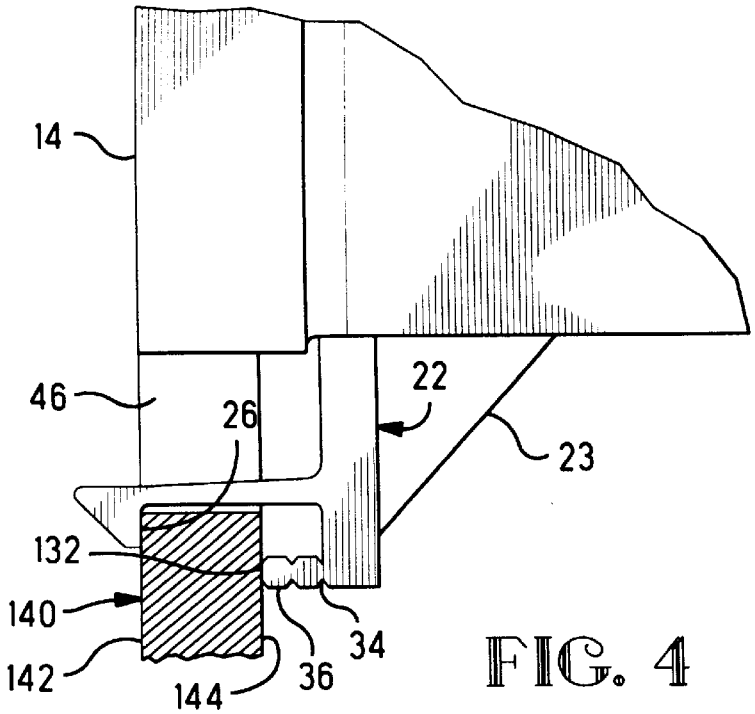
FIG. 4 is a view similar to that of FIG. 3 WITH the connector mounted to a thicker panel.

FIGS. 3 and 4 illustrate the connector 10 mounted to respective thin panel 40 and thicker panel 140. As can be seen in FIG. 3, leading end 32 of arm 30 engages surface 44 of panel 40. In FIG. 4 leading end 132 of the arm 30 engages a second surface 144 of panel 140 while the latching surface 26 engages the first surface 142 thereof.

In manufacturing the housing, the flange 22 is integrally molded onto the side 16 of base 20. To reinforce the flange, a support portion 22 shown as a triangular section in FIG. 3 and 4 may be used.

As can readily be seen in FIG. 3 and 4, the connector housing made in accordance with the invention is adaptable to accommodate a number of thicknesses of panels by severing the spacing arms 30 at a desired location. Additionally, the spacing arms 30 may be severed to different respective lengths on the respective sides of the connector 10 to secure the connector at a panel structure having different thicknesses on the two sides of the opening. The present invention provides a cost effective method of manufacturing a connector that allows the end user to utilize the same connector for a variety of panels, thus minimizing inventory.

It is thought that the panel mountable connector of the present invention and many of its attendant advantages will be understood from the foregoing description. It is apparent that various changes may be made in the form, construction, and arrangement of parts thereof without departing from the spirit or scope of the invention, or sacrificing all of its material advantages.

I claim:

1. An electrical connector adapted to be inserted into and retained in a panel opening, said connector comprising:

a dielectric housing having flanges extending outwardly from opposed sides thereof proximate a panel mounting face;

each flange having a resilient latching arm extending forwardly therefrom at a first location therealong, said arm having a latching surface at the leading end thereof adapted to engage a first side of the panel when said connector is inserted into said panel opening from a second side of said panel; and each said flange further including a spacing arm at a second location therealong extending forwardly to a leading end, said second location being outward of said first location from the associated side of said housing, said spacing arm coextending alongside said resilient arm, said spacing arm being substantially non-resilient and adapted to abut a surface; said leading end of said spacing arm being spaced rearwardly from said latching surface a selected distance such that, upon inserting said connector into said panel opening from said second side, said latching arms engage said first side of said panel and said leading ends of said spacing arms engage said second side, thereby securing said connector in said panel opening; and each said spacing arm includes at least one frangible section at a selected location to facilitate severing of said arm at said location thereby permitting said connector to be mounted to a thicker panel.

2. The connector of claim 1 wherein said frangible section is defined by a notch.

3. The connector of claim 1 wherein each said spacing arm includes a plurality of said frangible sections wherein said arm may be severed at a defined location to readily accommodate panels having different thicknesses.

* * * * *